US007587159B2

(12) United States Patent
Fuwa et al.

(10) Patent No.: US 7,587,159 B2
(45) Date of Patent: Sep. 8, 2009

(54) IMAGE FORMING METHOD AND APPARATUS INCLUDING A RELATIONSHIP BETWEEN SECONDARY ROLLER DIAMETER AND RECORDING MEDIUM INGRESS POSITION

(75) Inventors: Kazuoki Fuwa, Toyonaka (JP); Masayuki Hagi, Minoo (JP); Yoshihiro Mikuriya, Nishinomiya (JP); Hideaki Yasunaga, Ibaraki (JP); Hiroaki Kato, Nagaokakyo (JP); Yoshitaka Sekiguchi, Nishinomiya (JP); Yoshie Iwakura, Higashiosaka (JP)

(73) Assignee: Ricoh Company, Ltd., Tokyo (JP)

( * ) Notice: Subject to any disclaimer, the term of this patent is extended or adjusted under 35 U.S.C. 154(b) by 18 days.

(21) Appl. No.: 11/855,739

(22) Filed: Sep. 14, 2007

(65) Prior Publication Data

US 2008/0069605 A1 Mar. 20, 2008

(30) Foreign Application Priority Data

Sep. 15, 2006 (JP) ..... 2006-251301

(51) Int. Cl.
*G03G 15/14* (2006.01)

(52) U.S. Cl. ..... 399/302; 399/308

(58) Field of Classification Search ..... 399/302, 399/308; 430/108.1, 110.3, 110.4, 111.4
See application file for complete search history.

(56) References Cited

U.S. PATENT DOCUMENTS

| | | | | |
|---|---|---|---|---|
| 6,139,990 | A * | 10/2000 | Kubota et al. | 429/231.8 |
| 6,746,810 | B2 * | 6/2004 | Suzuki et al. | 430/119.86 |
| 2004/0175641 | A1 * | 9/2004 | Nanya et al. | 430/109.4 |
| 2005/0106481 | A1 * | 5/2005 | Ayaki et al. | 430/45 |
| 2006/0057482 | A1 * | 3/2006 | Yuasa | 430/108.2 |
| 2006/0063093 | A1 * | 3/2006 | Kurosu | 430/122 |
| 2006/0204882 | A1 | 9/2006 | Nozaki et al. | |
| 2006/0210326 | A1 | 9/2006 | Takehara et al. | |
| 2006/0210327 | A1 | 9/2006 | Iwakura et al. | |
| 2006/0210902 | A1 | 9/2006 | Nakamura et al. | |
| 2006/0257176 | A1 | 11/2006 | Kawasaki et al. | |
| 2006/0275686 | A1 | 12/2006 | Kadota et al. | |
| 2006/0292474 | A1 | 12/2006 | Mikuriya et al. | |
| 2007/0026335 | A1 | 2/2007 | Yamamoto et al. | |
| 2007/0059625 | A1 | 3/2007 | Yamamoto et al. | |
| 2007/0122729 | A1 | 5/2007 | Katoh et al. | |
| 2007/0148568 | A1 | 6/2007 | Kadota et al. | |
| 2007/0190443 | A1 | 8/2007 | Hagi et al. | |

(Continued)

FOREIGN PATENT DOCUMENTS

JP 2001-183912 7/2001

(Continued)

*Primary Examiner*—David M Gray
*Assistant Examiner*—G. M. Hyder
(74) *Attorney, Agent, or Firm*—Oblon, Spivak, McClelland, Maier & Neustadt, P.C.

(57) ABSTRACT

Provided is an image forming method that comprises a charging step, an exposing step, a developing step, an intermediate transfer step and a secondary transfer step, wherein the diameter R (mm) of a secondary transfer roller used in the secondary transfer step and the distance A (mm) between a nip center of the secondary transfer roller and a site where paper contacts with a secondary transfer belt at ingress side satisfy the following relation, and the charge amount Q (μC/g) of the toner going into the secondary transfer step satisfies the following relation.

$$R/40<A<R/15$$

$$15/A^2<Q<35/A^2.$$

20 Claims, 2 Drawing Sheets

U.S. PATENT DOCUMENTS

| | | | | |
|---|---|---|---|---|
| 2007/0207399 | A1 | 9/2007 | Kadota et al. | |
| 2007/0238042 | A1 * | 10/2007 | Yasunaga et al. ..... | 430/108.1 |

FOREIGN PATENT DOCUMENTS

| | | | |
|---|---|---|---|
| JP | 2003-167444 | | 6/2003 |
| JP | 2003167444 | A * | 6/2003 |
| JP | 2005-25171 | | 1/2005 |
| JP | 2005-99775 | | 4/2005 |
| JP | 2006-11072 | | 1/2006 |
| JP | 2006-23540 | | 1/2006 |
| JP | 2006-30654 | | 2/2006 |
| JP | 2006-39229 | | 2/2006 |
| JP | 2006-47358 | | 2/2006 |
| JP | 2006-53201 | | 2/2006 |
| JP | 2006-99029 | | 4/2006 |
| JP | 2006-113420 | | 4/2006 |

* cited by examiner

IMAGE FORMING METHOD AND APPARATUS INCLUDING A RELATIONSHIP BETWEEN SECONDARY ROLLER DIAMETER AND RECORDING MEDIUM INGRESS POSITION

BACKGROUND OF THE INVENTION

1. Field of the Invention

The present invention relates to electrophotographic image forming methods and image forming apparatuses, which utilize oil-less fixing, such as of copiers and facsimiles.

2. Description of the Related Art

In recent years, low-end laser beam printers have been lowered in cost, small-sized and increased in speed. It may be possible to change intermediate transfer belts from three-roll type to two-roll type thereby to reduce height and size of apparatuses; however, there arises a problem that electric discharge tends to occur since a gap generates between paper and intermediate transfer belts at secondary transfer.

It may be also possible to reduce the size by way that paper-ejection point of resist rollers, which being currently disposed upper side of secondary transfer portion, is disposed toward secondary transfer rollers from the tangent line of secondary nip portions; however, there also arises a problem that electric discharge tends to occur since a gap also generates between paper and intermediate transfer belts at secondary transfer.

Japanese Patent Application Laid-Open (JP-A) No. 2001-183912, for example, proposes a transfer device that comprises a transferring-conveying belt, a unit of applying a transfer charge, and a unit of discharging an electrostatic charge, in which the transferring-conveying belt forms a transfer nip by way of carrying and conveying a transferred body and contacting and pressing an image bearing member through the transferred body, the unit of applying a transfer charge applies a transfer charge to the transferring-conveying belt to transfer a toner image on the image bearing member to the transferred body, and the unit of discharging an electrostatic charge decreases the electrostatic charge on the transferring-conveying belt at the site from the downstream in the direction to move the transferring-conveying belt to adjacent to the transfer nip. Consequently, a transfer device and an image forming apparatus may be provided that can prevent abnormal images by way of suppressing discharge between the intermediate transfer belt and the transferring-conveying belt at the site from the downstream in the direction to move the transferring-conveying belt to adjacent to the transfer nip.

JP-A No. 2003-167444 proposes an image forming apparatus that comprises an image bearing member, an exposing unit, a developing unit to visualize electrostatic latent images on the image bearing member by developers of respective colors, a primary transfer unit to transfer images sequentially on the image bearing member onto an intermediate transfer body at a transfer site, a secondary transfer unit to transfer images superimposed on the intermediate transfer body onto a transfer material collectively at a secondary transfer site, and a pair of rollers to convey the transfer material to the secondary transfer site, in which among the pair of conveying rollers at immediate upstream from the secondary transfer site, the roller, non-contacting with the transfer surface of the transfer material to transfer the images at the secondary transfer site, rotates at a higher circumferential speed and has a larger friction coefficient with the transfer material. Consequently, inferior images can be allegedly prevented, in which the inferior images are induced in a manner that abnormal discharge generates at gaps between paper and intermediate belts, the toners are scattered to unintended sites, and toner density considerably decreases at the sites where the discharge generates.

However, the proposals described above still suffer from inferior transfer and uneven discharge.

BRIEF SUMMARY OF THE INVENTION

It is an object of the present invention to provide an image forming method and an image forming apparatus that are free from inferior transfer and uneven discharge.

The object invention may be attained by the present invention described below.

In an aspect of the present invention, an image forming method is provided that comprises a charging step, in which a surface of an image bearing member is charged, an exposing step, in which the charged surface of the image bearing member is exposed to form an electrostatic latent image, a developing step, in which the electrostatic latent image is developed to form a visible image by use of toner, an intermediate transfer step, in which the visible image is transferred from the image bearing member to an intermediate transfer body at a primary transfer portion, and a secondary transfer step, in which the visible image is transferred from the intermediate transfer body to a recording medium, in which the diameter R (mm) of a secondary transfer roller used in the secondary transfer step and the distance A (mm) between a nip center of the secondary transfer roller and a site where the recording medium contacts with a secondary transfer belt at ingress side satisfy the following relation, $$R/40<A<R/15$$

and, the charge amount Q (μC/g) of the toner going into the secondary transfer step satisfies the following relation:

$$15/A^2<Q<35/A^2.$$

Preferably, the intermediate transfer body is a belt-like member that is tensioned by two rollers.

Preferably, the roller among the two rollers, facing the secondary transfer roller through the intermediate transfer body, has a diameter $R_2$ (mm) having the following relation:

$$0.8\times R\leqq R_2\leqq 1.2\times R.$$

Preferably, the site to eject the paper is located toward the secondary transfer roller from the upstream tangent line at the secondary transfer portion.

Preferably, the toner has a volume average particle size of 5 μm to 12 μm.

Preferably, the toner comprises a discharge-type charge control agent containing boron, and the content of the charge control agent is 0.5 part by mass to 10 parts by mass based on 100 parts by mass of the binder resin.

Preferably, the volume resistivity of the toner is $1\times10^9$ ohm·cm to $1\times10^{11}$ ohm·cm.

Preferably, the toner has an average circularity of 0.89 to 0.93.

Preferably, the toner comprises 2.0 parts by mass to 5.0 parts by mass of silica based on 100 parts by mass of base toner.

Preferably, the bond strength of the silica is 30% to 80%.

In another aspect of the present invention, an image forming apparatus is provided that comprises a charging unit configured to charge a surface of an image bearing member, an exposing unit configured to expose the charged surface of the image bearing member to form an electrostatic latent image, a developing unit configured to develop the electrostatic latent image to form a visible image by use of toner, an intermediate transfer unit configured to transfer the visible image from the image bearing member to an intermediate transfer body at a primary transfer portion, and a secondary transfer unit configured to transfer the visible image from the intermediate transfer body to a recording medium, in which the diameter R (mm) of a secondary transfer roller and the distance A (mm) between a nip center of the secondary transfer roller and a site where the recording medium contacts with a secondary transfer belt at ingress side satisfy the following relation, $$R/40<A<R/15$$

and, the charge amount Q (μC/g) of the toner going into the secondary transfer step satisfies the following relation.

$$15/A^2<Q<35/A^2$$

Preferably, the intermediate transfer body is a belt-like member that is tensioned by two rollers.

Preferably, the roller among the two rollers, facing the secondary transfer roller through the intermediate transfer body, has a diameter $R_2$ (mm) having the following relation.

$$0.8\times R\leqq R_2\leqq 1.2\times R$$

Preferably, the site to eject the paper is located toward the secondary transfer roller from the upstream tangent line at the secondary transfer portion.

Preferably, the toner has a volume average particle size of 5 μm to 12 μm.

Preferably, the toner comprises a discharge-type charge control agent containing boron, and the content of the charge control agent is 0.5 part by mass to 10 parts by mass based on 100 parts by mass of the binder resin.

Preferably, the volume resistivity of the toner is $1\times10^9$ ohm·cm to $1\times10^{11}$ ohm·cm.

Preferably, the toner has an average circularity of 0.89 to 0.93.

Preferably, the toner comprises 2.0 parts by mass to 5.0 parts by mass of silica based on 100 parts by mass of base toner.

Preferably, the bond strength of the silica is 30% to 80%.

In accordance with the present invention, an image forming method and an image forming apparatus can be provided that are free from inferior transfer and uneven discharge.

DETAILED DESCRIPTION OF THE INVENTION

Figure 1:
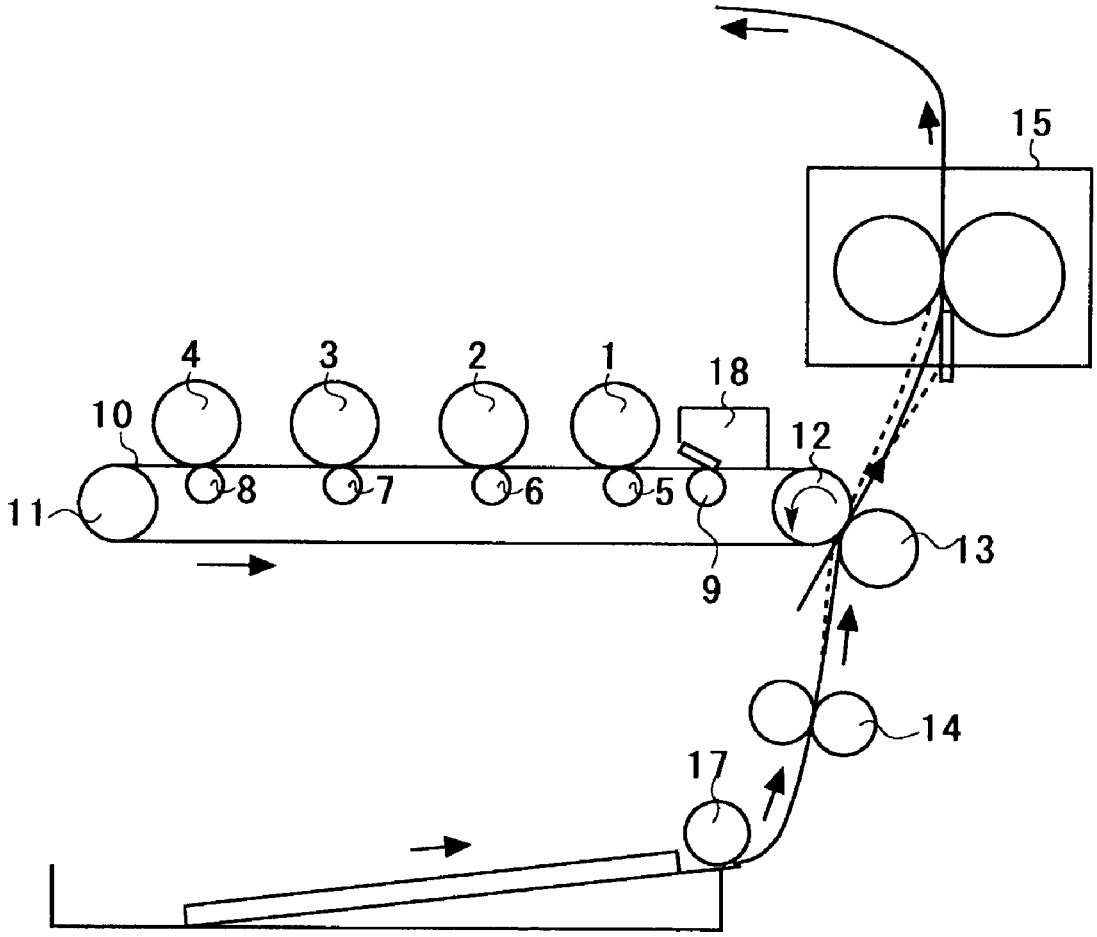
FIG. 1 exemplarily shows a transfer device suited to the inventive image forming method.

Image Forming Method and Image Forming Apparatus

The inventive image forming method comprises a charging step, an exposing step, a developing step, an intermediate step, and a secondary transfer step, and also optional other steps such as a fixing step, a cleaning step, a charge eliminating step, a recycling step and a control step as required. The charging step and the exposing step are sometimes referred to as an electrostatic latent image forming step.

The inventive image forming apparatus comprises a charging unit, an exposing unit, a developing unit, an intermediate unit, and a secondary transfer unit, and also optional other units such as a fixing unit, a cleaning unit, a charge eliminating unit, a recycling unit and a control unit as required. The charging unit and the exposing unit are sometimes referred to as an electrostatic latent image forming unit.

The inventive image forming method can be carried out by use of the inventive image forming apparatus, the charging step can be carried out by use of the charging unit, the exposing step can be carried out by use of the exposing unit, the developing step can be carried out by use of the developing unit, the intermediate step can be carried out by use of the intermediate unit, the secondary transfer step can be carried out by use of the secondary transfer unit, and other steps can be carried out by use of the other units.

In accordance with the present invention, the following relations are required:

$$R/40<A<R/15$$

$$35/A^2<Q<15/A^2$$

in which R (mm) is a diameter of a secondary transfer roller, A (mm) is a distance between a nip center of the secondary transfer roller and a site where paper contacts with a secondary transfer belt at ingress side, and Q (μC/g) is a charge amount of toner going into secondary transfer.

When the distance A between the secondary transfer roller and the site where paper contacts at ingress side is no more than R/40 or no less than R/15, inferior transfer or uneven discharge is likely to occur.

When the charge amount Q of toner going into the secondary transfer step is no less than $35/A^2$, the charge amount of toner is excessively large, or when the charge amount Q is no more than $15/A^2$, the charge amount of toner is excessively small; in both cases, inferior transfer or uneven discharge is likely to occur.

It is preferred that the intermediate transfer body is a belt-like member that is tensioned by two rollers. Among the two rollers of driving rollers, the roller, facing the secondary transfer roller to form a nip therebetween through the intermediate transfer body, preferably has a diameter $R_2$ having the following relation.

$$0.8\times R\leqq R_2\leqq 1.2\times R$$

In the paper feed process that the paper of recording medium is fed, conveyed, and ejected from the resist roller that is disposed upstream of the secondary transfer portion, it is also preferred that the site to eject the paper is located toward the secondary transfer roller from the upstream tangent line at the secondary transfer portion.

FIG. 1 shows a transfer device of an image forming apparatus suited to the inventive image forming method.

An image forming unit is disposed that has four photoconductors 1 to 4, an intermediate transfer belt 10 is tensioned by driving rollers 11 and 12 and a secondary transfer roller 13 (R=17 mm); respective colors are superimposed on the intermediate transfer belt 10 to form a color image by applying a certain potential to the primary transfer rollers 5 to 8 along the direction to convey the intermediate transfer belt 10. In the image forming unit, the charge amount of toner is controlled by a control roller and a developing roller.

Paper of recording medium is conveyed by a paper feed roller 17 and a resist roller 14 from a paper feed tray, and the resulting color image is transferred on the paper by applying a certain potential to the secondary transfer roller 13, and fixed by a fixing unit 15 and then is output. The residual toner, which being not transferred by the secondary transfer roller 13 and remaining on the intermediate transfer belt 10, is collected into a cleaner unit 18.

Figure 2:
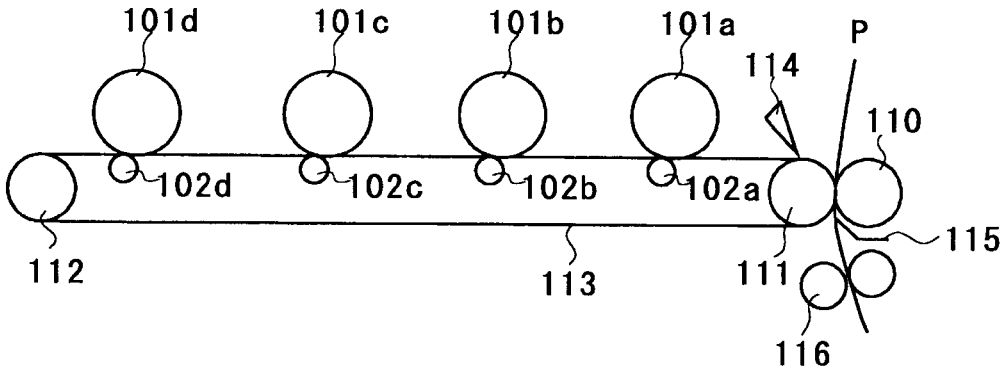
FIG. 2 exemplarily shows a transfer portion of the inventive image transfer apparatus.

FIG. 2 is a view of a transfer portion of the inventive image transfer apparatus, showing photoconductors 101*a* to 101*d*, and an intermediate transfer belt 113. The respective colors are superimposed on the intermediate transfer belt 113 by the photoconductors 101*a* to 101*d* thereby to form a color image. A roller 111 facing the secondary transfer roller and a driving roller 112 rotate thereby to transfer a color image on the intermediate transfer belt 113 to a paper of recording medium conveyed by a resist roller 116 at the nip portion of the secondary transfer roller.

Figure 3:
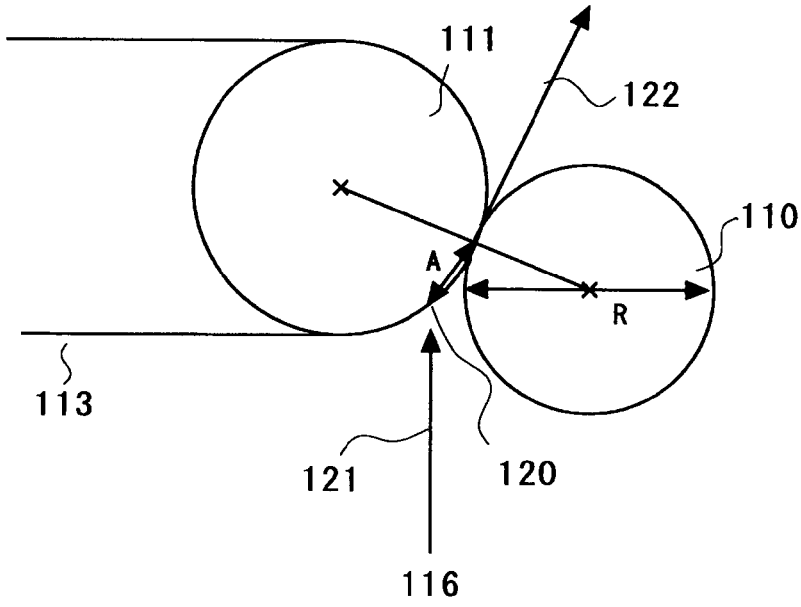
FIG. 3 exemplarily shows a nip portion of a secondary transfer roller in the inventive image forming apparatus.

FIG. 3 is a view of a nip portion of the secondary transfer roller in the inventive image forming apparatus, showing a site 120 where a recording medium contacts with the intermediate transfer belt at ingress side and traveling directions 121, 122 of the recording medium. R is a diameter of the secondary transfer roller, and A is a distance between a nip center of the secondary transfer roller and a site where the recording medium contacts with the secondary transfer belt at ingress side. The paper of the recording medium is conveyed by the resist roller 116, contacts with the roller 111, facing the secondary transfer roller, at the site 120 of ingress side, is transferred a color image, and is conveyed to the fixing device.

Table 1 below shows a relation between the distance A (mm) and discharge trace, in which the distance A is the length between the nip center of the secondary transfer roller and the site where the recording medium contacts with a secondary transfer belt at ingress side of upstream of the secondary transfer nip portion. Table 2 below shows a relation between an entry angle of the recording medium and image blur of a primary transfer image due to plunge into the driving roller.

It is understood from the result of Table 1 that A of less than 1.5 mm corresponds to occurrence of discharge trace and A of 1.5 mm or more corresponds to no occurrence of discharge trace; it is understood from the result of Table 2 that the entry angle of the recording medium of more than 30 degrees causes image blur of primary transfer image due to plunge into the driving roller.

TABLE 1

| | distance A (mm) | | | |
|---|---|---|---|---|
| | 0 | 0.5 | 1.0 | 1.5≦ |
| discharge trace | X | X | X | O |

TABLE 2

| | entry angle of recording medium (degree) | | | | |
|---|---|---|---|---|---|
| | 0 | 10 | 20 | 30 | 30< |
| discharge trace | O | O | O | O | X |

The smaller is R or the smaller is A, the angle tends to be larger between the paper of fixing medium and the intermediate transfer belt. When the angle for the transfer material comes to larger, the layout tends to allow discharge due to gap between the paper and the belt. When the intermediate transfer belt is tensioned by two rollers in particular, the angle particularly tends to increase, thus the object of the present invention is likely to be practical. When the diameter of the roller, facing the secondary transfer roller to form a nip therebetween through the intermediate transfer body, comes to smaller, the angle also tends to increase.

Toner

The toner in the present invention comprises a first binder resin to which a hydrocarbon wax is internally added, a second binder resin, a colorant, a charge control agent, and an external additive, and also other ingredients as required.

Binder Resin

The first binder resin and the second binder resin may be properly selected from conventional ones in the field of full-color toner; examples of these binder resins include polyester resins, (meth)acrylic resins, styrene-(meth)acrylic copolymer resins, epoxy resins, and cycloolefin copolymer resins (e.g., TOPAS-COC, by Ticona Co.). Among these, both of the first binder resin and the second binder resin are preferably polyester resins in view of oil-less fixing.

The polyester resins may be those produced by polycondensation of polyvalent alcohols and polyvalent carboxylic acids.

Divalent alcohols among the polyvalent alcohols are exemplified by alkylene oxide adducts of bisphenol A such as polyoxypropylene(2.2)-2,2-bis(4-hydroxyphenyl)propane, polyoxypropylene(3.3)-2,2-bis(4-hydroxyphenyl) propane, polyoxypropylene(6)-2,2-bis(4-hydroxyphenyl)propane, and polyoxyethylene(2.0)-2,2-bis(4-hydroxyphenyl)propane; ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polytetramethylene glycol, bisphenol A, and hydrogenated bisphenol A.

Trivalent or more alcohols are exemplified by sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

Divalent carboxylic acids among the polyvalent carboxylic acids are exemplified by maleic acid, fumaric acid, citraconic acid, itaconic acid, gulutaconic acid, phthalic acid, isophthalic acid, terephthalic acid, cyclohexane dicarboxylic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, isooctenylsuccinic acid, n-octylsuccinic acid, isooctylsuccinic acid, and acid anhydrides thereof or lower alkyl esters thereof.

The trivalent or more carboxylic acids are exemplified by 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Enpol trimer acid, and acid anhydrides thereof or lower alkyl esters thereof.

The polyester resins may be those produced by mixing a raw monomer of polyester resin, a raw monomer of vinyl resin, and a monomer reactive with both of the monomers, and subjecting the mixture to a polycondensation reaction to produce a polyester resin as well as a radical polymerization reaction to produce a vinyl resin in a vessel (hereinafter referred to as "vinyl polyester resin"). The monomer reactive with both of the monomers described above is one suited to a polycondensation reaction as well as a radical polymerization; that is, a monomer having a carboxylic group capable of undergoing a polycondensation reaction and a vinyl group capable of undergoing a radical polymerization reaction; examples thereof include fumaric acid, maleic acid, acrylic acid and methacrylic acid.

The raw monomer of the polyester resins may be the above-noted polyvalent alcohols or polyvalent carboxylic acids.

Examples of the raw monomer of the vinyl resins include styrene and styrene derivatives such as o-methylstyrene, m-methylstyrene, p-methylstyrene, α-methylstyrene, p-ethylstyrene, 2,4-dimethylstyrene, p-tert-butylstyrene, and p-chlorostyrene; ethylenically unsaturated monoolefins such as ethylene, propylene, butylene and isobutylene; alkyl methacrylates such as methyl methacrylate, n-propyl methacrylate, isopropyl methacrylate, n-butyl methacrylate, isobutyl methacrylate, t-butyl methacrylate, n-pentyl methacrylate, isopentyl methacrylate, neopentyl methacrylate, 3-(methyl) butyl methacrylate, hexyl methacrylate, octyl methacrylate, nonyl methacrylate, decyl methacrylate, undecyl methacrylate and dodecyl methacrylate; alkyl acrylates such as methyl acrylate, n-propyl acrylate, isopropyl acrylate, n-butyl acrylate, isobutyl acrylate, t-butyl acrylate, n-pentyl acrylate, isopentyl acrylate, neopentyl acrylate, 3-(methyl)butyl acrylate, hexyl acrylate, octyl acrylate, nonyl acrylate, decyl acrylate, undecyl acrylate and dodecyl acrylate; unsaturated carboxylic acids such as acrylic acid, methacrylic acid, itaconic acid and maleic acid; acrylonitrile, maleic acid esters, itaconic acid esters, vinyl chloride, vinyl acetate, vinyl benzoate, vinyl methylethylketone, vinyl hexylketone, vinyl methylether, vinyl ethylether and vinyl isobutylether.

Polymerization initiators to polymerize the raw monomers of vinyl resin are exemplified by azo or diazo polymerization initiators such as 2,2'-azobis(2,4-dimethylvaleronitrile), 2,2'-azobisisobutyronitrile, 1,1'-azobis(cyclohexane-1-carbonitrile), and 2,2'-azobis-4-methoxy-2,4-dimethylvaleronitrile; and peroxide polymerization initiators such as benzoyl peroxide, dicumyl peroxide, methylethylketonedicumyl peroxide, isopropylperoxycarbonate and lauroyl peroxide.

The first binder resin and the second binder resin are preferably polyester resins described above; in particular, those shown below are more preferable form the view point of oil-less fixing toner with higher releasing ability and offset resistance.

More preferably, the first binder resin is a polyester resin that is produced by a polycondensation reaction of the polyvalent alcohols and the polyvalent carboxylic acids; in particular, the polyvalent alcohol is an alkylene oxide adduct of bisphenol A, and the polycarboxylic acid is terephthalic acid, fumaric acid.

More preferably, the second binder resin is a vinyl polyester resin, in particular, one produced by use of an alkylene oxide adduct of bisphenol A, terephthalic acid, trimellitic acid, and succinic acid as the raw monomer of the polyester resin, styrene, butylacrylate as the raw monomer of vinyl resin, and fumaric acid as the monomer reactive with both of the monomers.

As described above, a hydrocarbon wax is internally added to the first binder resin at preparing thereof in the present invention. In order to internally add the hydrocarbon wax to the first binder resin, for example, the first binder is synthesized in a condition that the hydrocarbon wax is also added to the reactant that includes the monomers of the first binder resin; that is, the polycondensation is carried out for the reactant that contains an acid monomer and an alcohol monomer for the polyester resin and also the hydrocarbon wax. When the first binder resin is a vinyl polyester resin, the polycondensation reaction and the radical polymerization reaction may be carried out in a manner that the raw monomer of the vinyl resin is added to the mixture of the monomer of polyester resin and the hydrocarbon wax while heating and stirring the mixture.

Wax

The toner contains a wax as a releasing agent in order to assure the releasing ability between paper and fixing devices in the process of fixing toner images on the paper.

Waxes having a lower polarity may typically exhibit excellent releasing ability against fixing rollers. In the present invention, the wax is preferably a hydrocarbon wax having a lower polarity.

In general, the hydrocarbon wax contains exclusively carbon atoms and hydrogen atoms and no ester, alcohol, or amide groups. Specific examples of the hydrocarbon wax include polyolefin waxes such as of polyethylene, polypropylene, and ethylene-propylene copolymer; petroleum waxes such as paraffin wax and microcrystalline wax; and synthetic waxes such as Fischer-Tropsch wax. Among these, polyethylene wax, paraffin wax and Fischer-Tropsch wax are more preferable, and polyethylene wax and paraffin wax are particularly preferable.

Wax Dispersant

The toner, used in the present invention, may contain a wax dispersant to assist the dispersion of wax. The wax dispersant may be conventional ones, and is exemplified by polymers or oligomers in which a unit having a high compatibility with wax and a unit having a high compatibility with resin exist as a blocked unit; polymers or oligomers in which one of a unit having a high compatibility with wax and a unit having a high compatibility with resin is grafted to another unit; copolymers of unsaturated hydrocarbons such as ethylene, propylene, butene, styrene and α-styrene and α- or β-unsaturated carboxylic acids such as acrylic acid, methacrylic acid, maleic acid, maleic anhydride, itaconic acid and itaconic anhydride or esters or anhydrides thereof; and block or graft copolymers of vinyl resins and polyesters.

The unit having a high compatibility with wax is exemplified by long-chain alkyl groups having 12 or more carbon atoms, and copolymers of polyethylene, polypropylene, polybutene, or polybutadiene therewith; the unit having a high compatibility with resins is exemplified by polyester and vinyl resins.

Charge Control Agent

The charge control agent to control the charge amount of toner may be conventional ones; and is exemplified by nigrosine dyes, triphenylmethane dyes, chromium-containing metal complex dyes, molybdic acid chelate pigments, rhodamine dyes, alkoxy amines, quaternary ammonium salts such as fluoride-modified quaternary ammonium salts, alkylamides, elemental phosphorus or compounds thereof, elemental tungsten or compounds thereof; fluoride activators, metallic salts of salicylic acid, and metallic salts of salicylic acid derivatives.

Specific examples thereof include Bontron 03 of nigrosine dye, Bontron P-51 of quaternary ammonium salt, Bontron S-34 of metal-containing azo dye, Bontron E-82 of oxynaphthoic acid metal complex, Bontron E-84 of salicylic acid metal complex, and Bontron E-89 of phenol condensate (by Orient Chemical Industries, Ltd.); TP-302 and TP-415 of quaternary ammonium salt molybdenum metal complex (by Hodogaya Chemical Co.); Copy Charge PSY VP2038 of quaternary ammonium salt, Copy Blue PR of triphenylmethane derivative, and Copy Charge NEG VP2036 and Copy Charge NX VP434 of quaternary ammonium salt (by Hoechst Ltd.); LRA-901, and LR-147 of boron metal complex (by Japan Carlit Co., Ltd.), copper phthalocyanine, perylene, quinacridone, azo pigment, and other high-molecular weight compounds having a functional group, such as sulfonic acid group, carboxyl group, and quaternary ammonium salt. Among these, those capable of controlling toner at a negative polarity are preferable, and those of discharge type containing boron are particularly preferable.

The content of the charge control agent in toner depends on the species of binder resins, optional additives, and toner producing processes like dispersion processes, thus is not limited specifically; preferably, the content is is 0.5 to 10 parts by mass based on 100 parts by mass of the binder resin, more preferably 0.5 to 1.5 parts by mass. The content of above 10 parts by mass may degrade the flowability of developers or lower the image density, since the charging ability of toner is excessively large, thus the effect of the charge control agent is deteriorated and electrostatic absorbing force is increased at developing rollers.

Colorant

The colorant may be properly selected from conventional dyes and pigments; examples thereof include carbon black, nigrosine dyes, iron black, Naphthol Yellow S, Hansa Yellow (10G, 5G, G), cadmium yellow, yellow iron oxide, yellow ocher, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, anthracene yellow BGL, isoindolinone yellow, colcothar, red lead oxide, lead red, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, lithopone and combinations thereof.

The amount of the colorant is preferably 1 to 15% by mass based on the toner, more preferably 3 to 10% by mass.

The colorant may be combined with a resin for binder resin and used in a form of masterbatch. The binder resin to prepare the master batch or to be kneaded with the master batch may be, in addition to polyester resins and vinyl resins, rosin, modified rosin, terpene resins, aliphatic or cycloaliphatic hydrocarbon resins, aromatic petroleum resins, chlorinated paraffin and paraffin wax; these may be used alone or in combination.

External Additive

As for the external additive in the present invention, inorganic fine particles are preferably used for the purpose of auxiliarily improving flowability, charging ability, developing ability, or transfer ability of toner.

BET surface area of the inorganic fine particles is preferably 30 to 300 $m^2/g$, and the primary particle diameter is preferably 10 to 50 nm.

Specific examples of inorganic fine particles include silica, zinc oxide, tin oxide, quartz sand, titanium oxide, clay, mica, silicic pyroclastic rock, diatomaceous earth, chromic oxide, cerium oxide, iron oxide red, antimony trioxide, magnesium oxide, aluminum oxide, zirconium oxide, barium sulfate, barium carbonate, calcium carbonate, silicon carbide, silicon nitride, and the like. These may be used alone or in combination of two or more. Among these, silica is particularly preferable.

When the primary particle diameter of the external additive is less than 10 nm, the embedding of the external additive into toner is likely to be inadequate, degradation or fluctuation of images may be significant, and images tend to be deteriorated with time; and when the primary particle diameter of the external additive is above 50 nm, the separation of the external additive from toner is likely to be significant, possibly resulting in filming on photoconductors.

Preferably, 2.0 to 5.0 parts by mass of silica is externally added to the toner based on 100 parts by mass of toner base.

Preferably, the bond strength of silica to the toner base is 30% to 80%, more preferably 40% to 60%. When the bond strength is less than 30%, the free external additive may affect images since the silica as the external additive to be fixed to the toner base is less, and when the bond strength is more than 80%, the spacer effect may be scarce since the silica embeds unduly into the toner base.

The bond strength of silica as the external additive to the toner base can be measured as follows.

A surfactant is diluted to 10 times, then 2 g of toner is added to 30 mL of the diluted surfactant solution, and the solution is allowed to infiltrate sufficiently, followed by energizing at 40 W for 1 minute using an ultrasonic homogenizer. Then the toner is separated from the slurry, and then is rinsed and dried. The content of the silica in the toner is measured before and after this procedure using a fluorescent X ray spectrometer, and the ratio of the silica contents is calculated to obtain the bond strength. In the fluorescent X ray spectrometry, each of the toners before and after the procedure described above is weighed in an amount of 2 g and shaped into a pellet by pressing at 1 $N/cm^2$ for 60 seconds, and the pellet is measured for Si content using a wavelength dispersive fluorescent X ray spectrometer (XRF1700, by Shimadzu Co.) based on a calibration curve method.

It is preferred that the toner has a volume average particle size of 5 to 12 μm, more preferably 6 to 10 μm in view of image quality. The volume average particle size may be measured by use of MultiSizer III (by Beckmann Coulter Inc.) described above.

It is preferred that the toner has an average circularity of 0.89 to 0.93. The average circularity means a value of circle circumference, having the same project area of toner particles to be measured, divided by the actual circumference of toner particles to be measured. The average circularity may be measured, for example, by the optical detection zone method in which a toner-containing suspension is passed through an image-detection zone disposed on a plate, the particle images of the toner are optically detected by a CCD camera, and the resulting particle images are analyzed. An available analyzing apparatus is a flow-type particle image analyzer FPIA- 2100 (by Sysmex Corp.). The toner-containing suspension may be prepared, for example, by way that 0.1 to 0.5 mL of a surfactant (e.g. alkylbenzene sulfonate) is dissolved into 100 to 150 mL of pure water; and 0.1 to 0.5 g of a sample toner is added to the solution. The mixture is stirred and dispersed for 1 to 3 minutes by use of an ultrasonic stirrer to prepare a suspension containing the toner particles in a concentration of 3,000 to 10,000/mL.

It is preferred that the toner has a volume resistivity of $1\times10^{9}$ to $1\times10^{11}$ ohm·cm.

The volume resistivity of toner may be measured by use of a digital ultra-high resistance/micro current meter R8340A at DC 500 V in a condition that the toner is sandwiched between electrodes of Sample box TR42 for ultra-high resistance meter (by Advantest Co.), for example.

EXAMPLES

The present invention will be explained with reference to Examples, but to which the present invention should in no way be limited. In the descriptions below, all parts and percentages are expressed by mass unless indicated otherwise.

Example to Produce Toner

Preparation of First Binder Resin

Initially, 600 g of styrene, 110 g of butyl acrylate, and 30 g of acrylic acid as vinyl monomers were charged into a dropping funnel along with 30 g of dicumyl peroxide as a polymerization initiator.

Then 1230 g of polyoxypropylene(2.2)-2,2-bis(4-hydroxyphenyl)propane and 290 g of polyoxyethylene(2.2)-2,2-bis(4-hydroxyphenyl)propane as polyol, 250 g of isododecenyl succinic anhydride, 310 g of terephthalic acid, 180 g of 1,2,4-benzenetricarboxylic anhydride, 7 g of dibutyltin oxide as an esterification catalyst, and 4 parts by mass of paraffin wax (melting point: 73.3° C., half-value width of temperature-rising endothermic peak: 4° C.) based on 100 parts by mass of total monomers were placed into a four-necked 5 L flask equipped with a thermometer, a stainless stirrer, a condenser, and a nitrogen gas inlet; then the mixture was heated by a mantle heater to 160° C. and stirred under nitrogen gas atmosphere, meanwhile the above-noted mixture of the vinyl monomers and dicumyl peroxide was dripped from the dropping funnel over one hour.

After allowing to progress the addition polymerization for 2 hours at 160° C., the reactant was heated to 230° C. to undergo a polycondensation reaction. The polymerization degree was measured using a capillary rheometer of constant-load extrusion type. The reaction was traced by means of the softening temperature, and the reaction was stopped when the softening temperature came to a desirable level thereby to prepare a resin H1. The softening temperature of the resin H1 was 130° C.

Preparation of Second Binder Resin

A total of 2210 g of polyoxypropylene(2.2)-2,2-bis(4-hydroxyphenyl)propane as a polyol, 850 g of terephthalic acid, and 120 g of 1,2,4-benzenetricarboxylic anhydride, and 0.5 g of dibutyltin oxide as an esterification catalyst, were placed into a four-necked 5 L flask equipped with a thermometer, a stainless stirrer, a condenser, and a nitrogen gas inlet, then the mixture was heated to 230° C. by a mantle heater under nitrogen gas atmosphere thereby to cause a polycondensation reaction. The polymerization degree was traced with reference to the softening temperature measured by the capillary rheometer of constant-load extrusion type; the reaction was stopped when the softening temperature came to a desirable level thereby to prepare a resin L1. The softening temperature of the resin L1 was 115° C.

Preparation of Toner

A master batch in an amount containing 4 parts of C.I. Pigment Red 57-1 was sufficiently mixed with a resin mixture of the first and the second binder resins in an amount of 100 parts (containing the mass of internal wax) using a Henschel mixer, then the mixture was melted and kneaded using a twin-screw extruding kneader (PCM-30, by Ikegai Tekko KK).

The kneaded product was calendered to a thickness of 2 mm using a cooled press roller and cooled by a cooling belt, followed by coarsely milled using a feather mill, then milled by a mechanical pulverizer (KTM, by Kawasaki Heavy Industries, Ltd.) into an average particle diameter of 10 to 12 μm. Then the product was milled by use of a jet mill (IDS, by Nippon Pneumatic Mfg. Co.) while classifying coarse particles, then fine particles were classified by use of a rotor-type classifier (Teeplex classifier, type 100ATP, by Hosokawa Micron Co.), thereby to prepare Color Resin Particle 1 having a volume average particle diameter of 9.0 μm and an average circularity of 0.915.

The resulting Color Resin Particle 1 in an amount of 100 parts and silica (TS530, by Cabosil Co.) of inorganic fine particles in an amount of 3.5 parts were mixed with a Henschel mixer to prepare a magenta toner.

Evaluation of Bond Strength of Silica

The resulting magenta toner of 2 g was added to 30 ml of a 10-times diluted surfactant solution and was allowed to infiltrate sufficiently. Then the suspension was energized by an ultrasonic homogenizer at an output of 40 W for 1 minute so as to separate partially the silica from the toner, followed by rinsing and drying. The contents of silica were measured, using a fluorescent X ray spectrometer, as regards before and after the procedures and the ratio of the Si contents was calculated. More specifically, 2 g of each toner of before and after the above-noted procedures was made into a pellet by applying a pressure of 1 N/cm$^2$ for 60 seconds and the silicon content was determined using a wavelength dispersive fluorescent X ray spectrometer (XRF1700, by Shimadzu Co.) based on a calibration curve method. Consequently, the bond strength of the silica to the toner base was determined to be 48%.

Volume Resistivity of Toner

The resulting toner was measured in term of the volume resistivity to be $7.0\times10^{10}$ ohm·cm by use of the digital ultra-high resistance/micro current meter R8340A at DC 500 V in a condition that the toner was sandwiched between electrodes of Sample box TR42 for ultra-high resistance meter (by Advantest Co.).

Examples 1 to 6 and Comparative Examples 1 to 5

Evaluation of Transfer Ability

A magenta solid image was printed by use of a modified image forming apparatus (based on IPSiO CX3000, by Ricoh Co.) while changing distance A (mm), in which the distance A being the length between the nip center of the secondary transfer roller and the site where paper contacts with a secondary transfer belt at ingress side of upstream of the secondary transfer nip portion, and was evaluated with respect to the transfer ability or unevenness in accordance with the criteria shown below. The diameter R (mm) of the second transfer roller in the second transfer step was 17.5 mm. The results are shown in Tables 3 and 4.

Evaluation Criteria

O: no problem in image quality

X: inferior transfer, occurrence of unevenness, problematic image

Evaluation of Charge Amount Q

The charge amount Q (μC/g) per unit mass was measured by way that the image forming apparatus is stopped at the stage when a toner image of 1 cm by 1 cm is formed on the intermediate transfer belt, the toner is vacuumed by a charge amount tester (Model 210HS-2A, by Trek Japan Co.) equipped with a filter layer, and the mass and the total charge amount of trapped are measured. The results are shown in Table 4.

TABLE 3

| | distance A (mm) | | | |
|---|---|---|---|---|
| | 0 | 0.5 | 1.0 | 1.5≦ |
| discharge trace | X | X | X | O |

TABLE 4

| | A (mm) | Q (μC/g) | Image |
|---|---|---|---|
| Ex. 1 | 0.81 | 38 | O |
| Ex. 2 | 0.71 | 63 | O |
| Ex. 3 | 0.68 | 49 | O |
| Ex. 4 | 0.52 | 80 | O |
| Ex. 5 | 1.13 | 18 | O |
| Ex. 6 | 0.69 | 47 | O |
| Com. Ex. 1 | 0.77 | 65 | X |
| Com. Ex. 2 | 0.68 | 30 | X |
| Com. Ex. 3 | 0.63 | 98 | X |
| Com. Ex. 4 | 0.57 | 41 | X |
| Com. Ex. 5 | 1.00 | 13 | X |

The toner in Example 6 contained a boron compound (LR-147, by Japan Carlit Co., Ltd.) as a charge control agent.

The results of Tables 3 and 4 demonstrate that Examples 1 to 6, which satisfy the relation of $15/A^2<Q<35/A^2$ may be free from inferior transfer and uneven images. The images were uneven in Comparative Examples 2, 4 and 5, which is believed by reason that the toner was scattered onto a paper of recording medium by action of electric discharge before transfer. The transfer was inferior in Comparative Examples 1 and 3 due to higher charge amount.

What is claimed is:

1. An image forming method, comprising:

charging a surface of an image bearing member, exposing the charged surface of the image bearing member to form an electrostatic latent image, developing the electrostatic latent image to form a visible image by use of toner, transferring the visible image from the image bearing member to an intermediate transfer body at a primary transfer portion, and transferring the visible image from the intermediate transfer body to a recording medium using a secondary transfer roller, wherein a diameter R (mm) of the secondary transfer roller and a distance A (mm) between a nip center of the secondary transfer roller and a site where the recording medium initially contacts a secondary transfer belt at a nip ingress side satisfy the following relation, $$R/40<A<R/15$$

wherein a magnitude of a charge amount Q in (μC/g) of the toner on the intermediate transfer body, when the visible image is transferred to the intermediate transfer body, is greater than fifteen divided by a magnitude of the distance A in (mm) squared, and wherein the magnitude of the charge amount Q in (μC/g) is less than thirty-five divided by the magnitude of the distance A in (mm) squared.

2. The image forming method according to claim 1, wherein the intermediate transfer body is a belt-like member that is tensioned by two rollers.

3. The image forming method according to claim 2, wherein a roller among the two rollers, facing the secondary transfer roller through the intermediate transfer body, has a diameter R2 (mm) having the following relation $$0.8\times R\leqq R2\leqq 1.2\times R.$$

4. The image forming method according to claim 1, wherein a site to eject the paper is located toward the secondary transfer roller from an upstream tangent line at the secondary transfer portion.

5. The image forming method according to claim 1, wherein the toner has a volume average particle size of 5 μm to 12 μm.

6. The image forming method according to claim 1, wherein the toner comprises a discharge-type charge control agent containing boron, and the content of the charge control agent is 0.5 part by mass to 10 parts by mass based on 100 parts by mass of a binder resin.

7. The image forming method according to claim 1, wherein a volume resistivity of the toner is 1×109 ohm·cm to 1×1011 ohm·cm.

8. The image forming method according to claim 1, wherein the toner has an average circularity of 0.89 to 0.93.

9. The image forming method according to claim 1, wherein the toner comprises 2.0 parts by mass to 5.0 parts by mass of silica based on 100 parts by mass of base toner.

10. The image forming method according to claim 9, wherein a relative bond strength of the silica is 30% to 80%, wherein the relative bond strength is determined by a method including:

measuring a first content of silica in a sample of a toner, adding the sample of the toner to a diluted surfactant solution to form a slurry, energizing the slurry, separating the sample of the toner from the slurry, rinsing the sample of the toner, drying the sample of the toner, measuring a second content of silica in the sample of the toner, and comparing the first content of silica to the second content of silica, wherein the relative bond strength of the silica is expressed as a percentage of the second content of silica relative to the first content of silica.

11. An image forming apparatus, comprising:

a charging unit configured to charge a surface of an image bearing member, an exposing unit configured to expose the charged surface of the image bearing member to form an electrostatic latent image, a developing unit configured to develop the electrostatic latent image to form a visible image by use of toner, an intermediate transfer unit configured to transfer the visible image from the image bearing member to an intermediate transfer body at a primary transfer portion, and a secondary transfer unit configured to transfer the visible image from the intermediate transfer body to a recording medium, wherein a diameter R (mm) of a secondary transfer roller and a distance A (mm) between a nip center of the secondary transfer roller and a site where the recording medium initially contacts with a secondary transfer belt at a nip ingress side satisfy the following relation, $$R/40<A<R/15$$

wherein a magnitude of a charge amount Q in (μC/g) of the toner going into the secondary transfer unit is greater than fifteen divided by a magnitude of the distance A in (mm) squared, and wherein the magnitude of the charge amount Q in (μC/g) is less than thirty-five divided by the magnitude of the distance A in (mm) squared.

12. The image forming apparatus according to claim 11, wherein the intermediate transfer body is a belt-like member that is tensioned by two rollers.

13. The image forming apparatus according to claim 12, wherein a roller among the two rollers, facing the secondary transfer roller through the intermediate transfer body, has a diameter R2 (mm) having the following relation $$0.8\times R\leqq R2\leqq 1.2\times R.$$

14. The image forming apparatus according to claim 11, wherein a site to eject the paper is located toward the secondary transfer roller from an upstream tangent line at a secondary transfer portion.

15. The image forming apparatus according to claim 11, wherein the toner has a volume average particle size of 5 μm to 12 μm.

16. The image forming apparatus according to claim 11, wherein the toner comprises a discharge-type charge control agent containing boron, and the content of the charge control agent is 0.5 part by mass to 10 parts by mass based on 100 parts by mass of a binder resin.

17. The image forming apparatus according to claim 11, wherein a volume resistivity of the toner is 1×109 ohm·cm to 1×1011 ohm·cm.

18. The image forming apparatus according to claim 11, wherein the toner has an average circularity of 0.89 to 0.93.

19. The image forming apparatus according to claim 11, wherein the toner comprises 2.0 parts by mass to 5.0 parts by mass of silica based on 100 parts by mass of base toner.

20. The image forming apparatus according to claim 19, wherein a relative bond strength of the silica is 30% to 80%:

wherein the relative bond strength is determined by a method including:

measuring a first content of silica in a sample of a toner, adding the sample of the toner to a diluted surfactant solution to form a slurry, energizing the slurry, separating the sample of the toner from the slurry, rinsing the sample of the toner, drying the sample of the toner, measuring a second content of silica in the sample of the toner, and comparing the first content of silica to the second content of silica, wherein the relative bond strength of the silica is expressed as a percentage of the second content of silica relative to the first content of silica.

* * * * *

UNITED STATES PATENT AND TRADEMARK OFFICE

CERTIFICATE OF CORRECTION

PATENT NO. : 7,587,159 B2
APPLICATION NO. : 11/855739
DATED : September 8, 2009
INVENTOR(S) : Fuwa et al.

It is certified that error appears in the above-identified patent and that said Letters Patent is hereby corrected as shown below:

On the title page, Item (30), the Foreign Application Priority Data information is incorrect. Item (30) should read:

-- (30) Foreign Application Priority Data

Sep. 15, 2006 (JP) ---------- 2006-251031 --

Signed and Sealed this

Tenth Day of November, 2009

David J. Kappos

David J. Kappos
*Director of the United States Patent and Trademark Office*